US011466520B2

(12) United States Patent
Sen et al.

(10) Patent No.: US 11,466,520 B2
(45) Date of Patent: Oct. 11, 2022

(54) SYSTEMS AND METHODS FOR INDICATING COMPLETION OF A REVERSE CEMENTING OPERATION

(71) Applicant: HALLIBURTON ENERGY SERVICES, INC., Houston, TX (US)

(72) Inventors: Tamal Kumar Sen, Kolkata (IN); Venkata Gopala Rao Palla, Pune (IN); Lonnie Carl Helms, Humble, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 393 days.

(21) Appl. No.: 16/487,366

(22) PCT Filed: Oct. 31, 2018

(86) PCT No.: PCT/US2018/058588
§ 371 (c)(1),
(2) Date: Aug. 20, 2019

(87) PCT Pub. No.: WO2020/091775
PCT Pub. Date: May 7, 2020

(65) Prior Publication Data

US 2021/0404269 A1 Dec. 30, 2021

(51) Int. Cl.

| | |
|---|---|
| ***E21B 17/14*** | (2006.01) |
| ***E21B 33/14*** | (2006.01) |
| ***E21B 43/08*** | (2006.01) |
| ***E21B 47/06*** | (2012.01) |
| *E21B 43/10* | (2006.01) |

(52) U.S. Cl.
CPC ..... *E21B 17/14* (2013.01); *E21B 33/14* (2013.01); *E21B 43/08* (2013.01); *E21B 47/06* (2013.01); *E21B 43/10* (2013.01)

(58) Field of Classification Search
CPC ..... E21B 17/14; E21B 33/14; E21B 43/08; E21B 47/06
See application file for complete search history.

(56) References Cited

U.S. PATENT DOCUMENTS

| | | | | |
|---|---|---|---|---|
| 5,494,107 | A | 2/1996 | Bode | |
| 7,303,008 | B2 | 12/2007 | Badalamenti et al. | |
| 8,316,936 | B2 * | 11/2012 | Roddy | E21B 41/0085 166/253.1 |
| 8,490,698 | B2 * | 7/2013 | Panga | C09K 8/80 166/308.4 |
| 9,309,735 | B2 * | 4/2016 | Anyan | E21B 21/002 |

(Continued)

FOREIGN PATENT DOCUMENTS

| | | | |
|---|---|---|---|
| GB | 2557797 | A | 6/2018 |
| WO | 2017111777 | A1 | 6/2017 |

OTHER PUBLICATIONS

International Search Report and Written Opinion dated Aug. 1, 2019, of PCT/US2018/058588, filed on Oct. 31, 2018.

*Primary Examiner* — Catherine Loikith
(74) *Attorney, Agent, or Firm* — K&L Gates LLP

(57) ABSTRACT

A shoe for use with a casing string in a borehole. The shoe may include a first screen positioned within a bore of the shoe or of the casing string near the shoe. The first screen may include orifices sized to prevent the passage of lost circulation material or a material with properties similar to the lost circulation material from outside the shoe through the first screen.

16 Claims, 7 Drawing Sheets

(56) References Cited

U.S. PATENT DOCUMENTS

| | | | | |
|---|---|---|---|---|
| 10,358,897 | B2 * | 7/2019 | Bowen | E21B 17/04 |
| 2004/0177962 | A1 | 9/2004 | Bour | |
| 2005/0034863 | A1 | 2/2005 | Dillenbeck et al. | |
| 2007/0062700 | A1 | 3/2007 | Webb et al. | |
| 2008/0060814 | A1 | 3/2008 | Badalamenti et al. | |
| 2009/0020285 | A1 | 1/2009 | Chase et al. | |
| 2012/0043079 | A1 * | 2/2012 | Wassouf | E21B 43/04 166/250.01 |
| 2016/0002998 | A1 * | 1/2016 | Wang | E21B 33/1208 166/382 |

* cited by examiner

SYSTEMS AND METHODS FOR INDICATING COMPLETION OF A REVERSE CEMENTING OPERATION

BACKGROUND

When drilling an oil or gas well, casing may be inserted in the borehole and cemented in place to provide structural strength or zonal isolation. Generally when cementing a well, a borehole is drilled and a casing string is inserted into the borehole. Drilling mud and/or a circulation fluid is then circulated from inside the casing and through an annulus between the casing and the borehole to flush debris from the well. Cement is then pumped into the annulus between the casing and the borehole.

One of two pumping methods is typically used to place the cement in the annulus. In the first method, the cement is pumped down the inside of the casing, out through a shoe at the bottom of the casing, and up through the annulus to its desired location. This is known as conventional cementing. In the second method, the cement is pumped directly down the annulus to displace well fluids present in the annulus by pushing them through the shoe and up into the casing inner diameter. This is known as reverse cementing.

In both conventional and reverse cementing, when the cement reaches the desired location, the flow of cement is stopped. In reverse cementing, several methods have been used to determine when to stop the flow of cement into the annulus. For example, logging tools and tagged fluids (by density and/or radioactive sources) may be used to monitor when cement has entered the shoe. The flow of cement is then stopped when the cement enters the shoe. Alternatively, the necessary volume of cement may be calculated and the flow of cement may be stopped when the calculated amount of cement has been flowed into the annulus.

However, there is a continuing need for improved methods for indicating when to stop the flow of cement into the annulus when performing a reverse cementing operation.

BRIEF DESCRIPTION OF THE DRAWINGS

Embodiments of the reverse cementing system are described with reference to the following figures. The same numbers are used throughout the figures to reference like features and components. The features depicted in the figures are not necessarily shown to scale. Certain features of the embodiments may be shown exaggerated in scale or in schematic form, and some details of elements may not be shown in the interest of clarity and conciseness.

DETAILED DESCRIPTION

The present disclosure provides systems and methods for conducting a reverse cementing operation during the process of drilling and completing a borehole. The systems and methods may be used to indicate when a flow of cement into an annulus formed between casing and a borehole should be stopped.

A main borehole may in some instances be formed in a substantially vertical orientation relative to a surface of the well, and a lateral borehole may in some instances be formed in a substantially horizontal orientation relative to the surface of the well. However, reference herein to either the main borehole or the lateral borehole is not meant to imply any particular orientation, and the orientation of each of these boreholes may include portions that are vertical, non-vertical, horizontal or non-horizontal. Further, the term "uphole" refers a direction that is towards the surface of the well, while the term "downhole" refers a direction that is away from the surface of the well.

Figure 1:
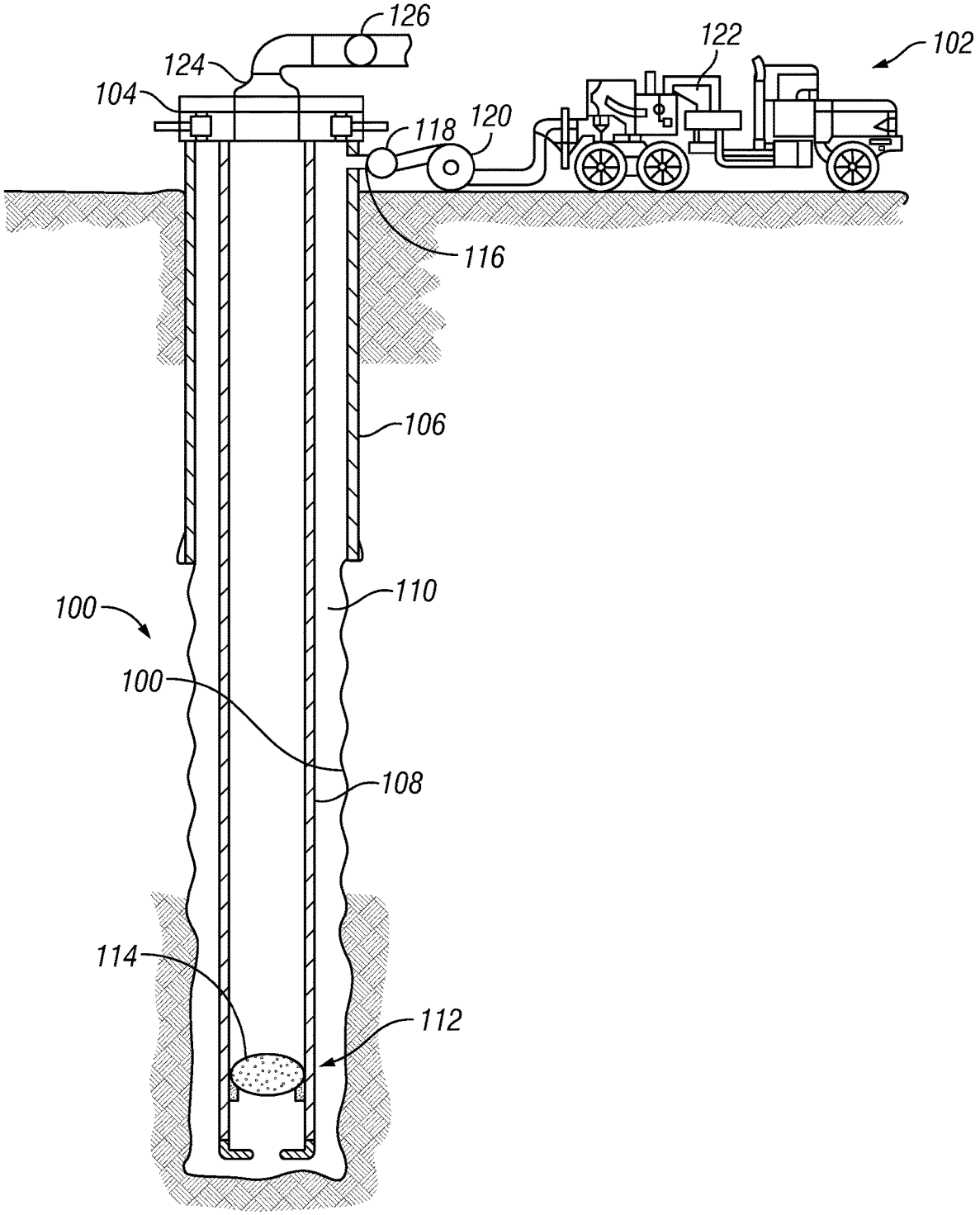
FIG. 1 is a cross-sectional diagram of a borehole with a reverse cementing system, according to one or more embodiments disclosed.

FIG. 1 is a cross-sectional diagram of a borehole 100 with a reverse cementing system 102, according to one or more embodiments disclosed. A well head 104 is attached to the top of surface casing 106 and a casing string 108 is suspended from the well head 104. An annulus 110 is defined between the casing string 108 and either the borehole 100 or the surface casing 106. A shoe 112 is attached to the bottom portion of the casing string 108 and includes a screen 114, as described in more detail below.

A feed line 116 is connected to the surface casing 106 to fluidly communicate with the annulus 110. Connected with the feed line 116 is a feed valve 118, a feed pump 120, and a cement truck 122. The feed valve 118 may be used to isolate the cement truck 122 from the well head 104 and the borehole 100. The feed line 116 may also be connected to a vacuum truck (not shown), a cement truck that includes a pump (not shown), or any other pumping mechanism known in the art for pumping fluids. A return line 124 is connected to the inner diameter of the casing string 108 through the well head 104. The return line 124 includes a return valve 126 used to isolate the borehole from the remainder of the return system (not shown) downstream of the return valve 126.

When conducting reverse cementing operations using the reverse cementing system 102, initially the space inside and the annulus 110 outside the casing string 108 is filled with drilling mud and cuttings. To remove the drilling mud and cuttings from the annulus 110, a spacer fluid is first pumped through the well head 104 and inside the bore of the casing string 108, through the shoe 112 and screen 114, and up through the annulus 110. Once the mud and cuttings have been cleared from the borehole 100, additional spacer fluid is pumped into the annulus and acts as a barrier between the drilling mud and cement that will be introduced into the borehole 100. The screen 114 includes orifices sized to allow particles in the spacer fluid to flow up inside the casing string. Once a sufficient amount of spacer fluid is pumped into the annulus 110, the flow of spacer fluid is stopped and cement is pumped through the wellhead 104 and into the annulus 110.

Lost circulation material, solid material that is introduced into the borehole 100 to prevent the flow of drilling fluid from the borehole 100 into the formation, is introduced into and suspended within the last portion of the spacer fluid that is pumped downhole, the first portion of the cement that is pumped downhole, or both. The lost circulation material may include, but is not limited to, shredded cellophane, mica, chopped formica, cotton seed hulls, chopped walnut shells, and/or fine steel beads. Regardless of the type, the lost circulation material pieces are sized so as to not be able to pass through the orifices of the screen 114. The lost circulation material may also seal pores in the formation that cause fluid losses. Materials with properties similar to lost circulation material may also be used and would be sized so as to not be able to pass through the orifices of the screen 114.

As the reverse cementing process continues, the cement fills the annulus 110 and begins to enter the shoe 112 of the casing string 108. As the spacer fluid within the shoe 112 is displaced by the cement, the lost circulation material is prevented from entering the remainder of the casing string 108 by the screen 114. The build-up of lost circulation material forms a filter cake on the screen 114 that prevents additional cement from entering the remainder of the casing string 108. The continued pumping of cement against the filter cake on the screen 114 creates an increase in pressure, also known as a pressure spike, within the annulus 110 and the feed line 116, signaling the completion of the reverse cementing process. A sensor or gauge on the cement truck 122 detects the pressure spike and the feed pump 120 is stopped. In at least one embodiment, a gauge or sensor (not shown) is connected to the feed line 116 in place of or in addition to the gauge or sensor on the cement truck 122.

Figure 2:
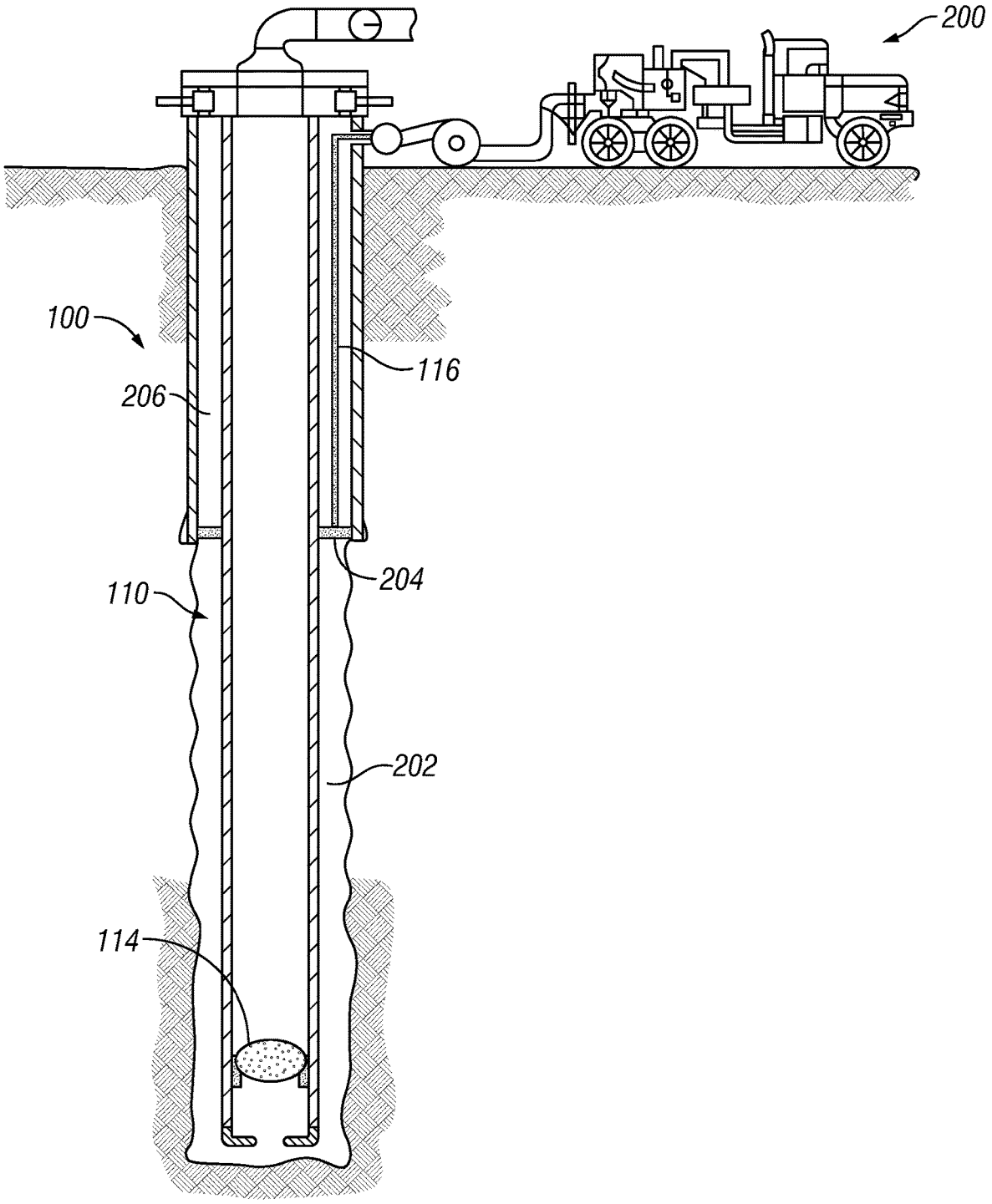
FIG. 2 is a cross-sectional diagram of a borehole with a reverse cementing system, according to one or more embodiments disclosed.

FIG. 2 is a cross-sectional diagram of a borehole 100 with a reverse cementing system 200, according to one or more embodiments disclosed Several elements of the reverse cementing system 200 are similar to those described above in relation to FIG. 1. Accordingly, similar elements will not be described again in detail.

As shown in FIG. 2, the reverse cementing system 200 is used to cement only a lower portion 202 of the annulus 110. A packer 204 is placed in the borehole 100 to isolate the lower portion 202 of the annulus 110 from the upper portion 206 of the annulus 110. The feed line 116 is extended to the packer 204, and the spacer fluid and cement are pumped into the lower portion 202 of the annulus 110 through the packer Similar to the reverse cementing system 102 shown in FIG. 1, cement being pumped against a filter cake formed on the screen 114 creates a pressure spike within the annulus 110 and the feed line 116, signaling the completion of the reverse cementing process.

Figure 3:
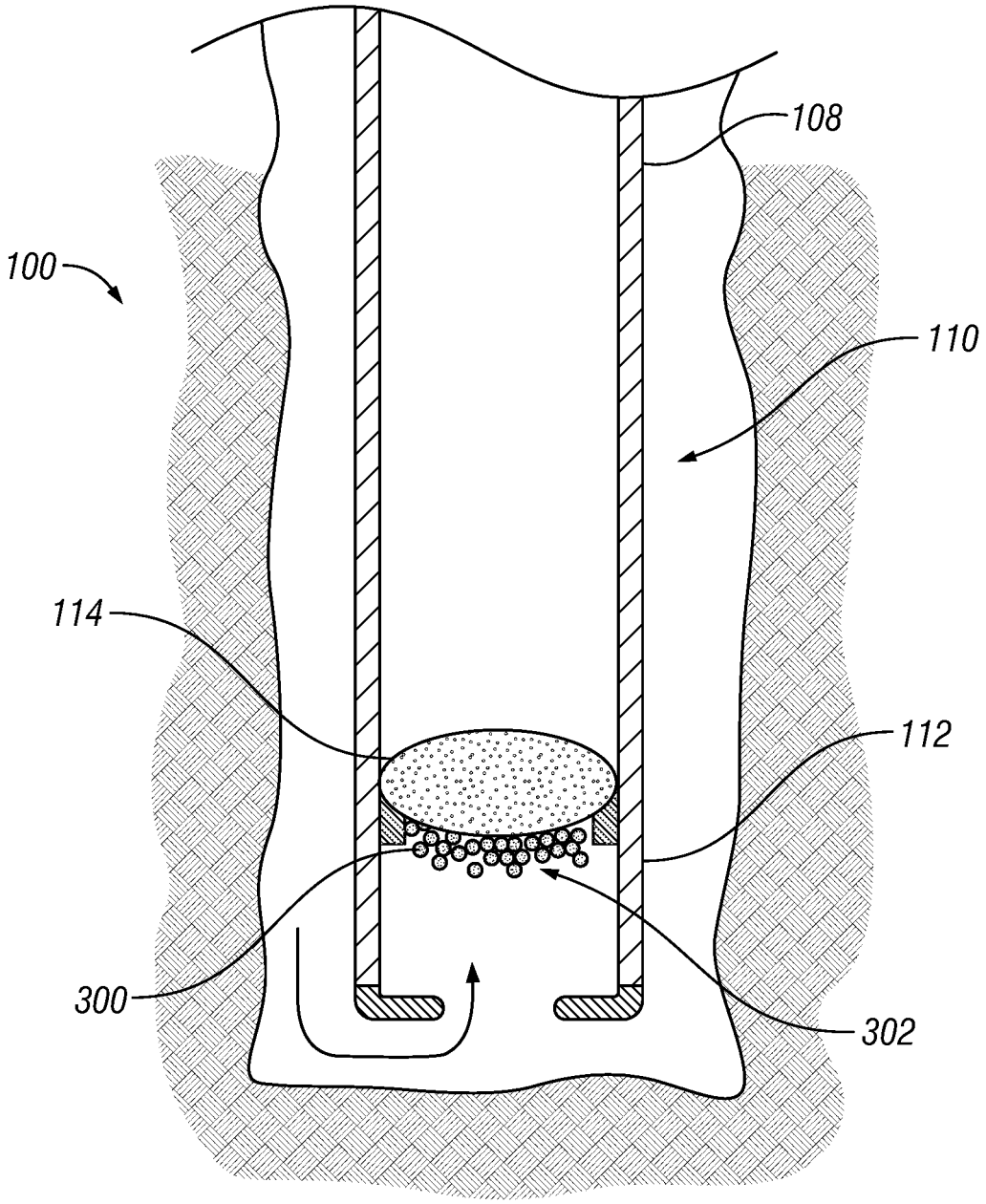
FIG. 3 is a cross-sectional diagram of the lower portion of the borehole of FIG. 1 with lost circulation material forming a filter cake on the screen.

FIG. 3 is a cross-sectional diagram of the lower portion of the borehole 100 of FIG. 1 or FIG. 2. As discussed above, the shoe 112 includes a screen 114 with orifices sized to allow the passage of the spacer fluid, drilling mud, and cuttings through the screen 114, but prevent the passage of lost circulation material 300. In at least one embodiment, the screen 114 is located within the shoe 112, as shown in FIG. 3. In other embodiments, the screen 114 may be installed between the shoe 112 and the remainder of the casing string 108, or as a part of the lower portion of the casing string 108.

As the lost circulation material 300 is pumped downhole with the spacer fluid and/or the cement, the lost circulation material 300 builds up on the screen 114, limiting the amount of cement that can enter the casing string 108 prior to the formation of a filter cake 302 on the screen 114, which blocks further passage of cement and/or spacer fluid. Once the screen 114 has been sufficiently blocked by the filter cake 302, the continued pumping of cement downhole through the annulus 110 will create a pressure spike, as the fluid pumped downhole can no longer enter the casing string 108. As previously discussed, the pressure spike is detected by sensors or gauges connected to the cement truck 122 and/or the feed line 116 to signal the delivery of the cement to the intended location. The flow of cement into the annulus 110 is then stopped.

Figure 4:
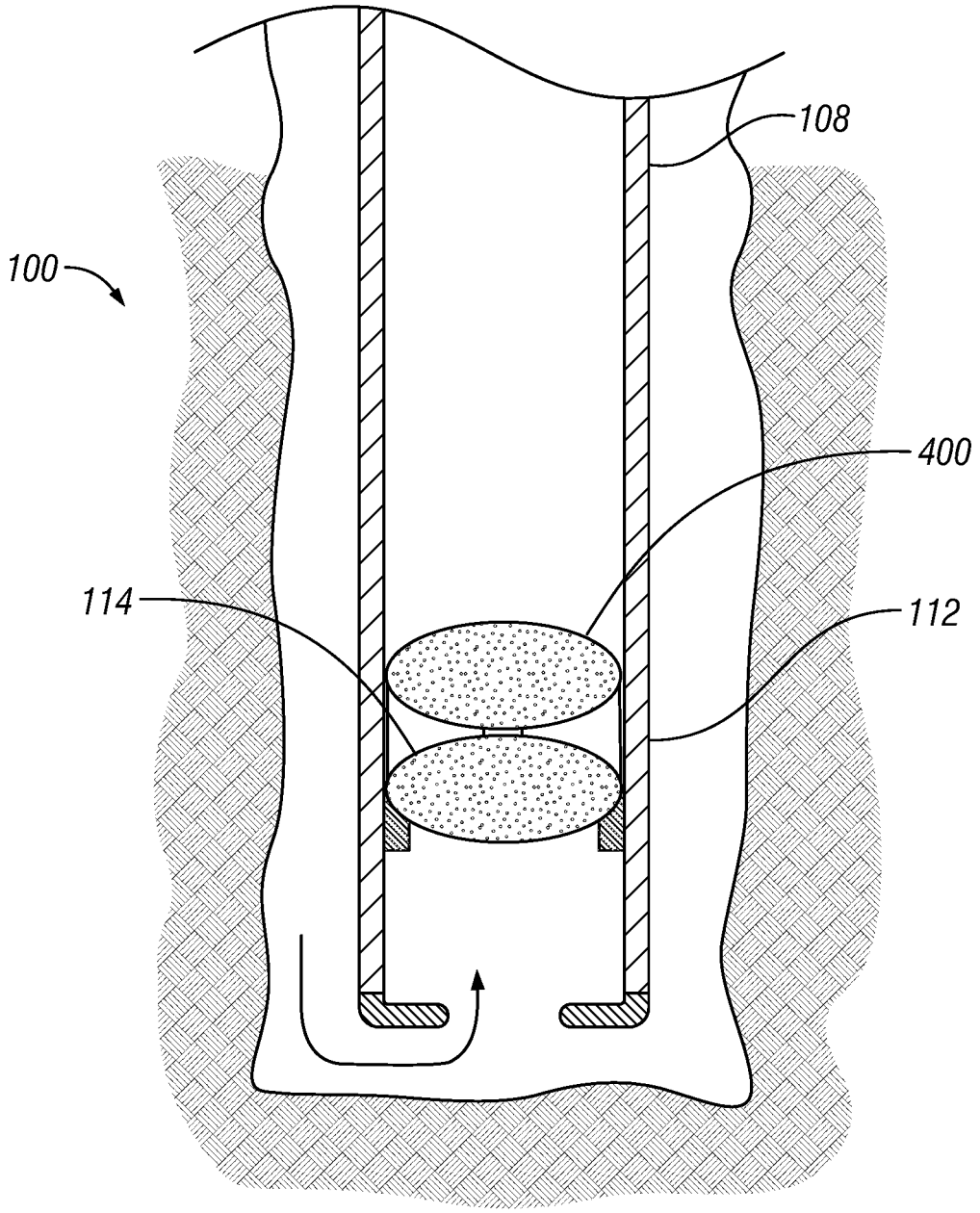
FIG. 4 is a cross-sectional diagram of a lower portion of a borehole, according to one or more embodiments disclosed.

As shown in FIG. 4, a second, upper screen 400 may be installed above the screen 114. In at least one embodiment, the upper screen 400 includes orifices that are the same size as the orifices of the screen 114 and acts as a redundant screen. In another embodiment, the lower screen 114 may have larger orifices than the upper screen 400, and the lower screen 114 may act as a filter to prevent larger particles, such as drill bit cuttings and other debris, from contacting the upper screen 400. The larger particles may collect on the filter screen 114 and form a filter cake before sufficient cement has been pumped into the borehole 100, prematurely stopping the feed pump 112 and necessitating a second cementing operation.

Figure 5:
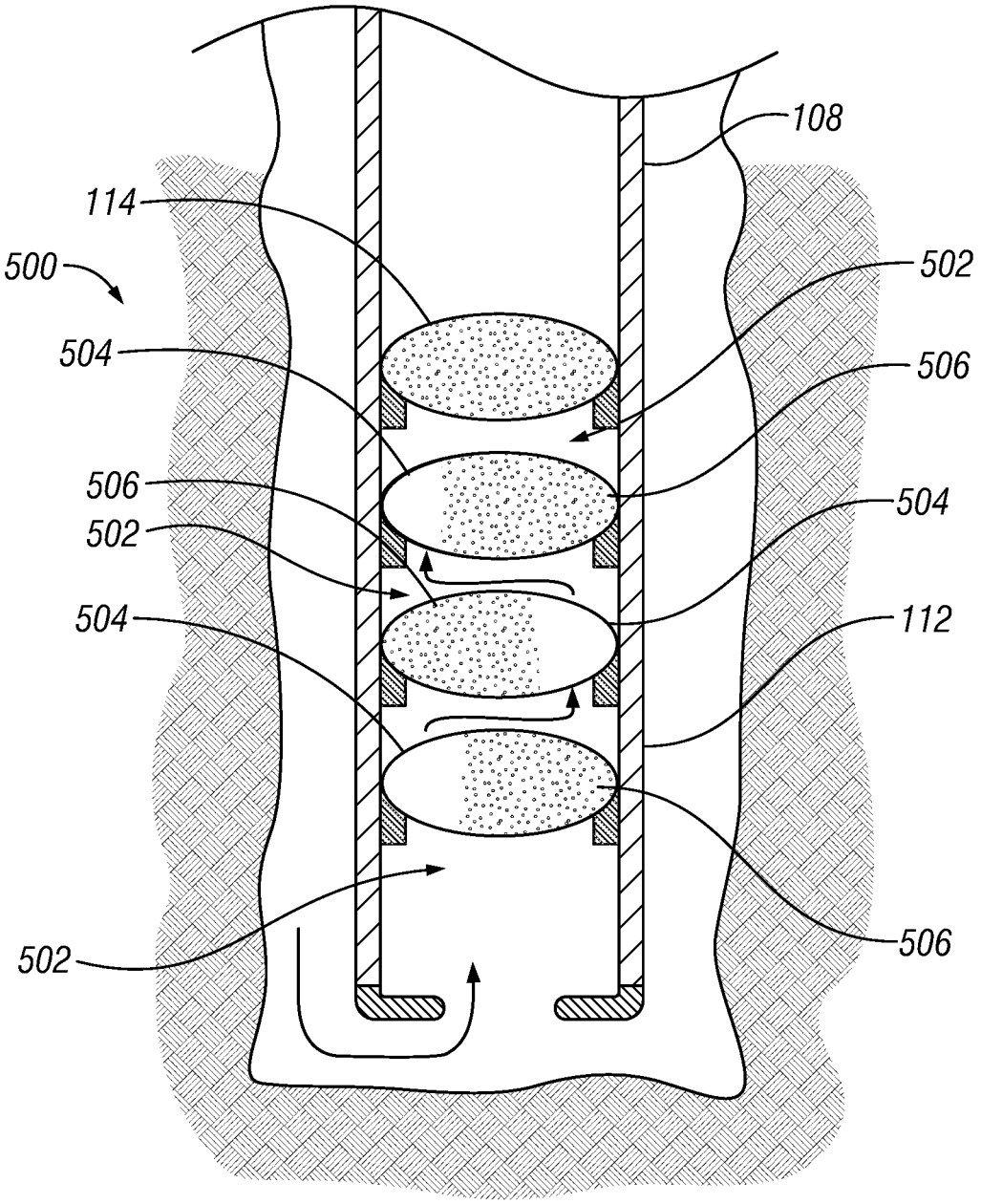
FIG. 5 is a cross-sectional diagram of a lower portion of a borehole, according to one or more embodiments disclosed.

FIG. 5 is a cross-sectional diagram of a lower portion of a borehole 500, according to one or more embodiments disclosed. The casing string 108, shoe 112, and screen 114 are similar to those described above in relation to FIG. 3. Accordingly, similar elements will not be described again in detail.

As shown in FIG. 5, a plurality of partial filters 502 may be installed in the shoe 112 and/or casing string 108 below the screen 114. Each partial filter 502 includes an open portion 504 and a filter screen 506 having a plurality of orifices. Although three partial filters 502 are shown, other embodiments may include one, two, four, or more partial filters 502.

The open portions 504 of adjacent partial filters 502 are on opposite sides of the partial filter 502, as shown in FIG. 5, creating a serpentine flowpath through the shoe 112 and/or casing string 108. In at least one embodiment, the orifices of the filter screens 506 may be sized to allow lost circulation material 300 to pass through, while preventing the passage of larger particles that may be in the spacer fluid or cement. In other embodiments, the size of the orifices of the filter screens 506 may decrease in size as the partial filters 502 are placed closer to the screen 114, progressively filtering the spacer fluid and/or cement before the spacer fluid and/or cement reach the screen 114, while still allowing the passage of the lost circulation material 300.

The partial filters 502 may also be angled within casing string 108 and/or shoe 112. Angling the partial filters 502 within the casing string 108 and/or shoe increases the surface area of the filter screen 506, which, in turn, increases the effectiveness of the partial filters 502 or reduce the number of partial filters 502 that are necessary to remove the desired amount of particles that are larger than the lost circulation material 300. In at least one embodiment, each partial filter 502 may be at a different angle within the casing string 108 and/or shoe 112. In other embodiments, two or more partial filters 502 may be at the same angle within the casing string 108 and/or shoe 112.

The partial filters 502 create a serpentine, torturous flowpath through the partial filters 502 that will allow the passage of the lost circulation material to the screen 114 but prevent particles larger than the lost circulation, such as drill bit cuttings and other debris, from reaching the screen 114. Accordingly, the partial filters 502 may ensure that a filter cake 302 is not formed on the screen 114 before sufficient cement has been pumped into the borehole 500 and preventing the need for a second cementing operation.

Figure 6:
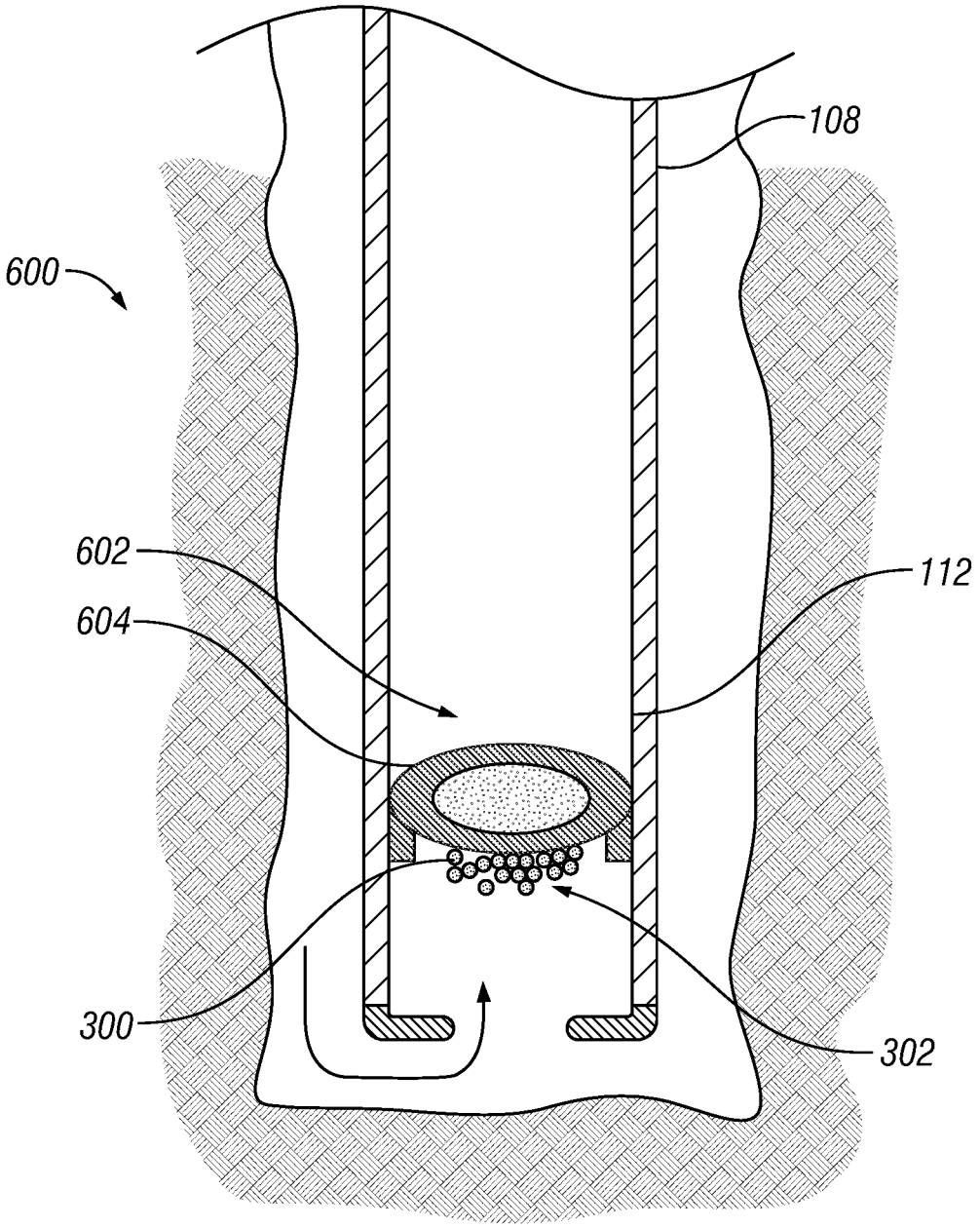
FIG. 6 is a cross-sectional diagram of a lower portion of a borehole, according to one or more embodiments disclosed.

FIG. 6 is a cross-sectional diagram of a lower portion of a borehole 600, according to one or more embodiments disclosed. The casing string 108 and shoe 112 are similar to those described above in relation to FIG. 3. Accordingly, similar elements will not be described again in detail.

As shown in FIG. 6, a screen 602 includes a solid outer ring 604 and is positioned within the shoe 112 in place of screen 114 shown in FIG. 3. As previously discussed, the screen 602 may be also installed between the shoe 112 and the remainder of the casing string 108, or as a part of the lower portion of the casing string 108.

The solid outer ring 604 of the screen 602 decreases the surface area of the screen 602 that fluid may pass through. The solid outer ring 604 therefore reduces the amount of lost circulation material 300 required to form a filter cake 302 on the screen 602. Reducing the required amount of lost circulation material necessary to form a filter cake may hasten the formation of the filter cake 302, limiting the passage of cement through the screen 602 and into the casing string 108 as the filter cake 302 is formed.

Figure 7:
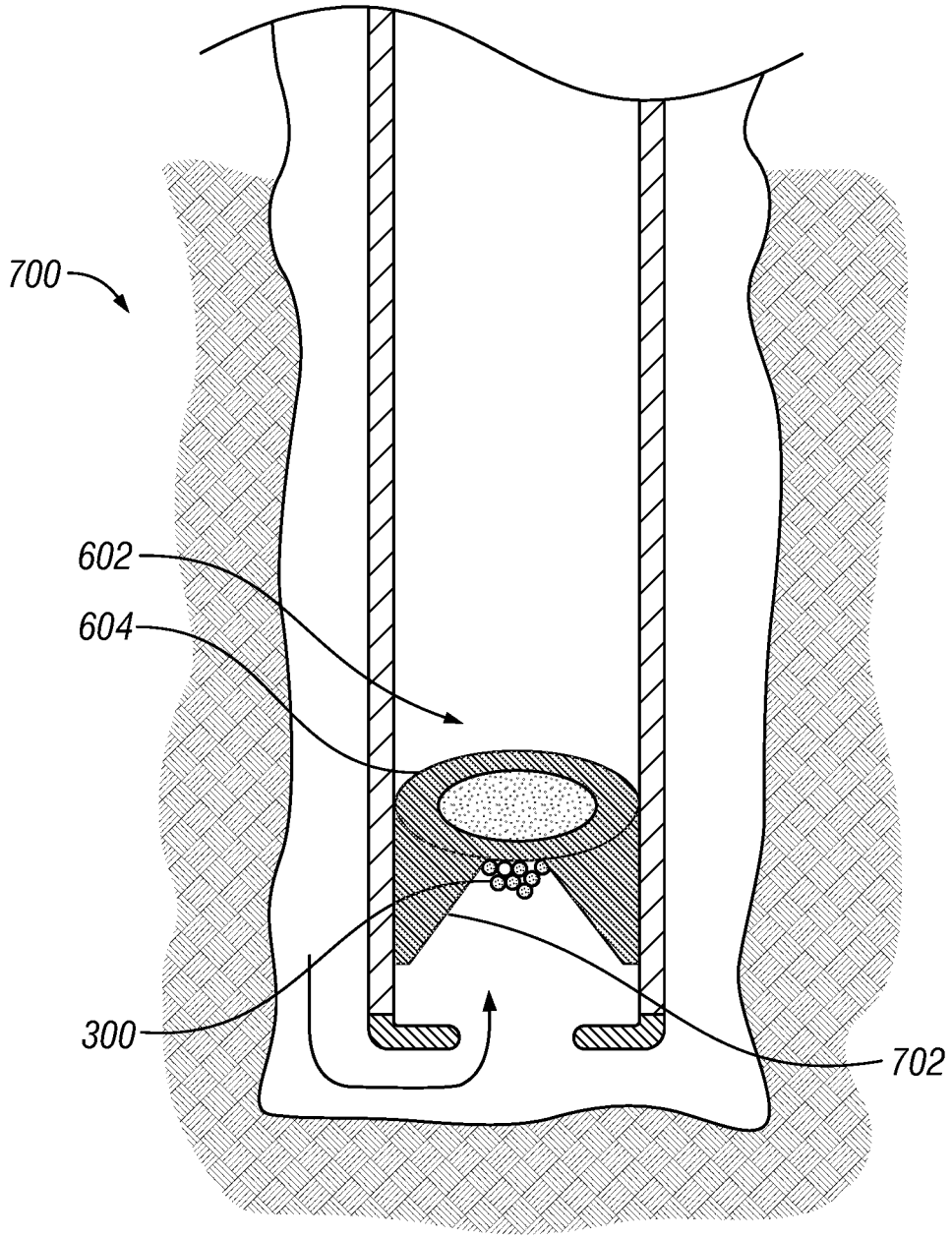
FIG. 7 is a cross-sectional diagram of a lower portion of a borehole, according to one or more embodiments disclosed.

FIG. 7 is a cross-sectional diagram of a lower portion of a borehole 700, according to one or more embodiments disclosed. FIG. 7 includes many features that are similar to those described in relation to FIG. 6. Accordingly, similar elements will not be described again in detail. As shown in FIG. 7, the solid outer ring 604 may also form a cone 702 that directs the lost circulation material 300 into the screen 602. In at least one embodiment, the cone 702 may be a separate component that is installed below the screen 602.

Certain embodiments of the disclosed invention may include a shoe for use with a casing string in a borehole. The shoe may include a first screen positioned within a bore of the shoe or of the casing string near the shoe. The first screen may include orifices sized to prevent the passage of lost circulation materials from outside the shoe through the first screen.

In certain embodiments, the shoe may also include a funnel positioned in the bore of the shoe and downhole of the first screen.

In certain embodiments, the shoe may also include partial filters positioned downhole of the first screen. Each partial filter may include orifices extending across only a portion of the bore of the shoe.

In certain embodiments, first screen may include an outer ring surrounding an area of the first screen comprising the orifices.

In certain embodiments, the shoe may also include a second screen positioned within the bore of the shoe.

In certain embodiments, the second screen may be positioned downhole of the first screen and the second screen may include orifices that are larger than the orifices of the first screen.

Certain embodiments of the disclosed invention may include a system for reverse cementing a borehole. The system may include a casing string, a pump, and at least one of a sensor or a gauge. The casing string may be disposed within the borehole and include a shoe that may include a first screen positioned within a bore of the shoe or the casing string near the shoe. The first screen may include orifices sized to prevent the passage of lost circulation materials from outside the shoe through the first screen. The pump may be configured to flow a fluid into an annular space between the borehole and the casing string. The sensor or gauge may be configured to monitor a pressure of the fluid flowing into the annular space.

In certain embodiments, the shoe may also include a funnel positioned in the bore of the shoe and downhole of the first screen.

In certain embodiments, the shoe may also include partial filters positioned downhole of the first screen. Each partial filter may include orifices extending across only a portion of the bore of the shoe.

In certain embodiments, first screen may include an outer ring surrounding an area of the first screen comprising the orifices.

In certain embodiments, the shoe may also include a second screen positioned within the bore of the shoe.

In certain embodiments, the second screen may be positioned downhole of the first screen and the second screen may include orifices that are larger than the orifices of the first screen.

Certain embodiments of the disclosed invention may include a method for reverse cementing a borehole. The method may include pumping cement and a lost circulation material into an annular space between a borehole and a casing string. The method may further include preventing the passage of the lost circulation material through a first screen of a shoe of the casing string. The method may also include detecting a pressure spike due to the prevention of the passage of the lost circulation material through the first screen. The method may also include stopping the pumping of cement into the annular space.

In certain embodiments, pumping cement into an annular space between a borehole and the casing string may include adding the lost circulation material to the cement.

In certain embodiments, the method may also include pumping a spacer fluid including the lost circulation material into the annular space before the cement.

In certain embodiments, pumping cement into an annular space between a borehole and the casing string may also include adding the lost circulation material to the cement.

In certain embodiments, preventing the passage of the lost circulation material through the first screen of the shoe may include directing the lost circulation material to the first screen via a funnel of the shoe.

In certain embodiments, preventing the passage of the lost circulation material through the first screen of the shoe may include filtering out particles that are larger than the lost circulation material before the particles reach the first screen.

In certain embodiments, the shoe may also include a second screen positioned downhole of the first screen and may include orifices that are larger than orifices of the first screen.

In certain embodiments, the shoe may also include partial filters positioned downhole of the first screen. Each partial filter may extend across only a portion of a bore of the shoe One or more specific embodiments of the system for indicating completion of a reverse cementing operation have been described. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time-consuming, but would nevertheless be a routine undertaking of design, fabrication, and manufacture for those of ordinary skill having the benefit of this disclosure.

Certain terms are used throughout the description and claims to refer to particular features or components. As one skilled in the art will appreciate, different persons may refer to the same feature or component by different names. This document does not intend to distinguish between components or features that differ in name but not function.

Reference throughout this specification to "one embodiment," "an embodiment," "embodiments," "some embodiments," "certain embodiments," or similar language means that a particular feature, structure, or characteristic described in connection with the embodiment may be included in at least one embodiment of the present disclosure. Thus, these phrases or similar language throughout this specification may, but do not necessarily, all refer to the same embodiment.

The embodiments disclosed should not be interpreted, or otherwise used, as limiting the scope of the disclosure, including the claims. It is to be fully recognized that the different teachings of the embodiments discussed may be employed separately or in any suitable combination to produce desired results. In addition, one skilled in the art will understand that the description has broad application, and the discussion of any embodiment is meant only to be exemplary of that embodiment, and not intended to suggest that the scope of the disclosure, including the claims, is limited to that embodiment.

What is claimed is:

1. A shoe for use with a casing string in a borehole, the shoe comprising:

a first screen positioned within a bore of the shoe or of the casing string near the shoe, the first screen comprising first orifices sized to prevent passage of lost circulation material or a material with properties similar to the lost circulation material from outside the shoe through the first screen; and a second screen positioned within the bore of the shoe and comprising second orifices of a different size than the first orifices.

2. The shoe of claim 1, wherein the second screen is positioned downhole of the first screen and the second screen comprises orifices that are larger than the orifices of the first screen.

3. A system for reverse cementing a borehole, the system comprising:

a casing string disposed within the borehole, the casing string comprising a shoe comprising a first screen positioned within a bore of the shoe or the casing string near the shoe, the first screen comprising orifices sized to prevent a passage of lost circulation material or a material with properties similar to the lost circulation material from outside the shoe through the first screen;

a pump configured to flow a fluid into an annular space between the borehole and the casing string; and at least one of a sensor or a gauge configured to monitor a pressure of the fluid flowing into the annular space and detect a pressure spike due to the prevention of the passage of the lost circulation material through the first screen.

4. The system of claim 3, wherein the shoe further comprises a funnel positioned within a bore of the shoe and downhole of the first screen.

5. The system of claim 3, wherein the shoe further comprises a plurality of partial filters positioned downhole of the first screen, each partial filter comprising orifices extending across only a portion of the bore of the shoe.

6. The system of claim 3, wherein the first screen comprises an outer ring surrounding an area of the first screen comprising the orifices.

7. The system of claim 3, wherein the shoe further comprises a second screen positioned within the bore of the shoe.

8. The system of claim 7, wherein the second screen is positioned downhole of the first screen and the second screen comprises orifices that are larger than the orifices of the first screen.

9. A method for reverse cementing a borehole, the method comprising:

pumping cement and lost circulation material or a material with properties similar to the lost circulation material into an annular space between a borehole and a casing string;

preventing passage of the lost circulation material or the material with properties similar to the lost circulation material through a first screen of a shoe of the casing string by filtering the lost circulation material or the material with properties similar to the lost circulation material with the screen;

detecting a pressure spike due to the prevention of the passage of the lost circulation material through the first screen by the filtering; and stopping the pumping of cement into the annular space.

10. The method of claim 9, wherein pumping cement into an annular space between a borehole and the casing string comprises adding the lost circulation material or the material with properties similar to the lost circulation material to the cement.

11. The method of claim 9, further comprising pumping a spacer fluid including the lost circulation material or the material with properties similar to the lost circulation material into the annular space before the cement.

12. The method of claim 11, wherein pumping cement into an annular space between a borehole and the casing string comprises adding the lost circulation material or the material with properties similar to the lost circulation material to the cement.

13. The method of claim 9, wherein preventing the passage of the lost circulation material or the material with properties similar to the lost circulation material through the first screen of the shoe comprises directing the lost circulation material or the material with properties similar to the lost circulation material to the first screen via a funnel of the shoe.

14. The method of claim 9, wherein preventing the passage of the lost circulation material or the material with properties similar to the lost circulation material through the first screen of the shoe comprises filtering out particles that are larger than the lost circulation material or the material with properties similar to the lost circulation material before the particles reach the first screen.

15. The method of claim 14, wherein the shoe further comprises a second screen positioned downhole of the first screen and comprising orifices that are larger than orifices of the first screen.

16. The method of claim 14, wherein the shoe further comprises partial filters positioned downhole of the first screen, each partial filter extending across only a portion of a bore of the shoe.

* * * * *